US007337888B2

(12) United States Patent
Neumann

(10) Patent No.: US 7,337,888 B2
(45) Date of Patent: Mar. 4, 2008

(54) CASH DISPENSER

(75) Inventor: Ulrich Neumann, Lippstadt (DE)

(73) Assignee: Wincor Nixdorf International GmbH, Paderborn (DE)

( * ) Notice: Subject to any disclaimer, the term of this patent is extended or adjusted under 35 U.S.C. 154(b) by 83 days.

(21) Appl. No.: 10/580,569

(22) PCT Filed: Sep. 24, 2004

(86) PCT No.: PCT/EP2004/010739

§ 371 (c)(1),
(2), (4) Date: May 24, 2006

(87) PCT Pub. No.: WO2005/062261

PCT Pub. Date: Jul. 7, 2005

(65) Prior Publication Data

US 2007/0102862 A1 May 10, 2007

(30) Foreign Application Priority Data

Nov. 28, 2003 (DE) ..... 103 55 637

(51) Int. Cl.
*G07D 7/00* (2006.01)

(52) U.S. Cl. ..... 194/206; 194/350

(58) Field of Classification Search ..... 194/205–207, 194/350; 902/9, 10; 232/43.1
See application file for complete search history.

(56) References Cited

U.S. PATENT DOCUMENTS 4,733,765 A * 3/1988 Watanabe ..... 194/206
5,467,976 A 11/1995 Doucet

FOREIGN PATENT DOCUMENTS

DE 33 16900 C2 10/1987
DE 101 03 120 C1 7/2002
EP 0 155 174 B2 10/1991
EP 0 109 743 B1 3/1992
EP 1 028 399 A1 8/2000

* cited by examiner

*Primary Examiner*—Patrick Mackey
*Assistant Examiner*—Mark J. Beauchaine
(74) *Attorney, Agent, or Firm*—McCormick, Paulding & Huber LLP

(57) ABSTRACT

The invention relates to a cash dispenser comprising a plurality of banknote compartments (20), disposed one after the other in a vertical position in a horizontal row, for receiving banknotes to be dispensed, wherein the banknote compartments (20) are associated with withdrawal and separation devices (26). The cash dispenser also comprises a stacking device (30) for forming a wad of banknotes to be dispensed, a single sheet transport device (28) for transporting individual banknotes from the withdrawal and separation devices (26) to the stacking device (30), a wad transport device (34) for transporting a wad of banknotes from the stacking device (30) to a dispenser slot (16) of the cash dispenser, and a return cassette (36) comprising a reject compartment (38) for receiving individual banknotes that were not dispensed. The single sheet transport device (28) can be optionally linked with an entrance opening (40) of the return compartment (36) or with the stacking device (30). The return cassette (36) also has at least one wad receiving compartment (52, 54), separate from the reject compartment (38), for receiving a wad of banknotes that was drawn back from the dispenser slot (16). The wad transport device (34) can be switched in regard to its direction of transport and can be optionally linked with the entrance opening of the wad receiving compartment (52, 54) via a switched branch.

13 Claims, 3 Drawing Sheets

CASH DISPENSER

CROSS-REFERENCE TO RELATED APPLICATIONS

This application is entitled to the benefit of and incorporates by reference essential subject matter disclosed in International Application No. PCT/EP04/010739 filed on Sep. 24, 2004 and German Patent Application No. 103 55 637.0 filed on Nov. 28, 2003.

FIELD OF THE INVENTION

The invention concerns a cash dispenser with a number of banknote cassettes for the reception of banknotes to be dispensed, wherein the banknote cassettes are each arranged in a vertical orientation and among themselves are arranged in a horizontal row behind one another, withdrawal and separating devices being associated with the banknote cassettes, with a stacking device for forming a bundle or wad of banknotes to be dispensed, with a single sheet transport device for transporting individual banknotes from the withdrawal and separating devices to the stacking device, with a wad transport device for the transport of a banknote wad from the stacking device to a dispensing compartment of the dispenser, and with a return cassette with a reject compartment for the reception of banknotes not suitable for dispensing, wherein the single sheet transport device can be optionally linked with an entrance opening of the return cassette or with the stacking device.

BACKGROUND OF THE INVENTION

In general, cash dispensers are known in which the banknote cassettes are arranged vertically on top of one another for horizontal installation, or in which, as in the present case, the banknote cassettes are arranged in a horizontal row behind one another for vertical installation.

Which construction is used depends to a large extent on the features of the building in which the cash dispenser is to be installed. Both forms of construction can, however, not be converted, without anything further, from one to the other by a 90° rotation.

This concerns especially the wad transport device which connects the stacking device with the output slot of the cash dispenser. In the case of both types of constructions, customarily, the return cassette is so arranged that banknotes, which are not suitable for dispensing, especially doubled withdrawals, in the region of the single sheet transport device and by the switching of a deflector, are not delivered to the stacking device but to the entrance opening of the return cassette.

In the case of money dispensers with banknote cassettes arranged vertically on top of one another, as described, for example, in EP 1 028 399 A, it is further known to provide a further compartment in the return cassette into which a banknote wad can be stored, which wad has already been offered to the customer in the dispensing slot and which has not been taken by the customer and therefore has been drawn back into the dispenser.

Since this money has already been booked out, the customer must be able to be made good again and, after the money has been drawn into the cash dispenser, it must be able to be associated with the customer.

This object is solved in accordance with the invention by the features mentioned in the present specification.

SUMMARY OF THE INVENTION

The invention has as its object, the provision of a cash dispenser of the previously mentioned kind, in which also by simple means it is possible to transport a banknote wad from the dispensing slot back into the return cassette.

This object is solved in accordance with the invention in that the return cassette has at least one wad compartment, separate from the reject compartment, for the reception of a banknote wad which has been pulled back from the dispending slot, in that the wad transport device is switchable in regard to its transport direction, and in that the wad transport device by way of a switchable branching is optionally linkable with an entrance opening of the wad receiving compartment.

In a preferred embodiment, the wad transport device is made as a belt transport mechanism with two belt stretches, each of which is guided over guiding and support rollers, and each of which belt stretches includes endless belts intended to engage the opposed flat sides of a banknote wad. One of the belt stretches at a branch location is divided into a portion associated with discharge and another portion associated with the stacker, and the branch location is connected by a branch transport device with the inlet opening of the wad receiving compartment. In the region of the branch location, the endless belts form at least one belt stretch which is formed to be at least somewhat elastic and therefore deflectable, and that thereby the discharge sided portion of the belt stretch is optionally linked with the branch transport device or with the stacker sided portion of the belt stretch. In this solution, according to the invention, the switching of a transport path from one condition to another in the wad transport device is achieved by a belt deflection. The deflection of the involved endless belts is achieved, for example, by means of an adjustable supporting roll. The supporting roll can, for example, be rotatably supported on a lever arm of a lever pivotal about a spatially fixed axis, another lever arm of which lever on a cam service of a switching cam.

The need for taking back a banknote bundle or wad offered at the dispensing slot occurs relatively seldom. However, since several banknote wads cannot be stored in common in one compartment, as then the banknotes could not be any longer be associated with the individual customers, it is necessary, if the return cassette has several wad receiving compartments, to have the input openings of those compartments selectively connectable with the branch transport device. With this arrangement, several banknote wads can be taken back without having to take the cash dispenser out of operation.

Further advantageous embodiments of the invention are given in the further dependent claims. It is to be emphasized that the proposed belt transport device with selectively deflectable endless belts for the purpose of forming a switch can also be used in applications beyond that of this special case, that is in a cash dispenser.

Further features and advantages of the invention will be apparent from the following description, which in combination with the accompanying drawings explain the invention by way of an exemplary embodiment.

DETAILED DESCRIPTION OF THE PREFERRED EMBODIMENTS

Figure 1:
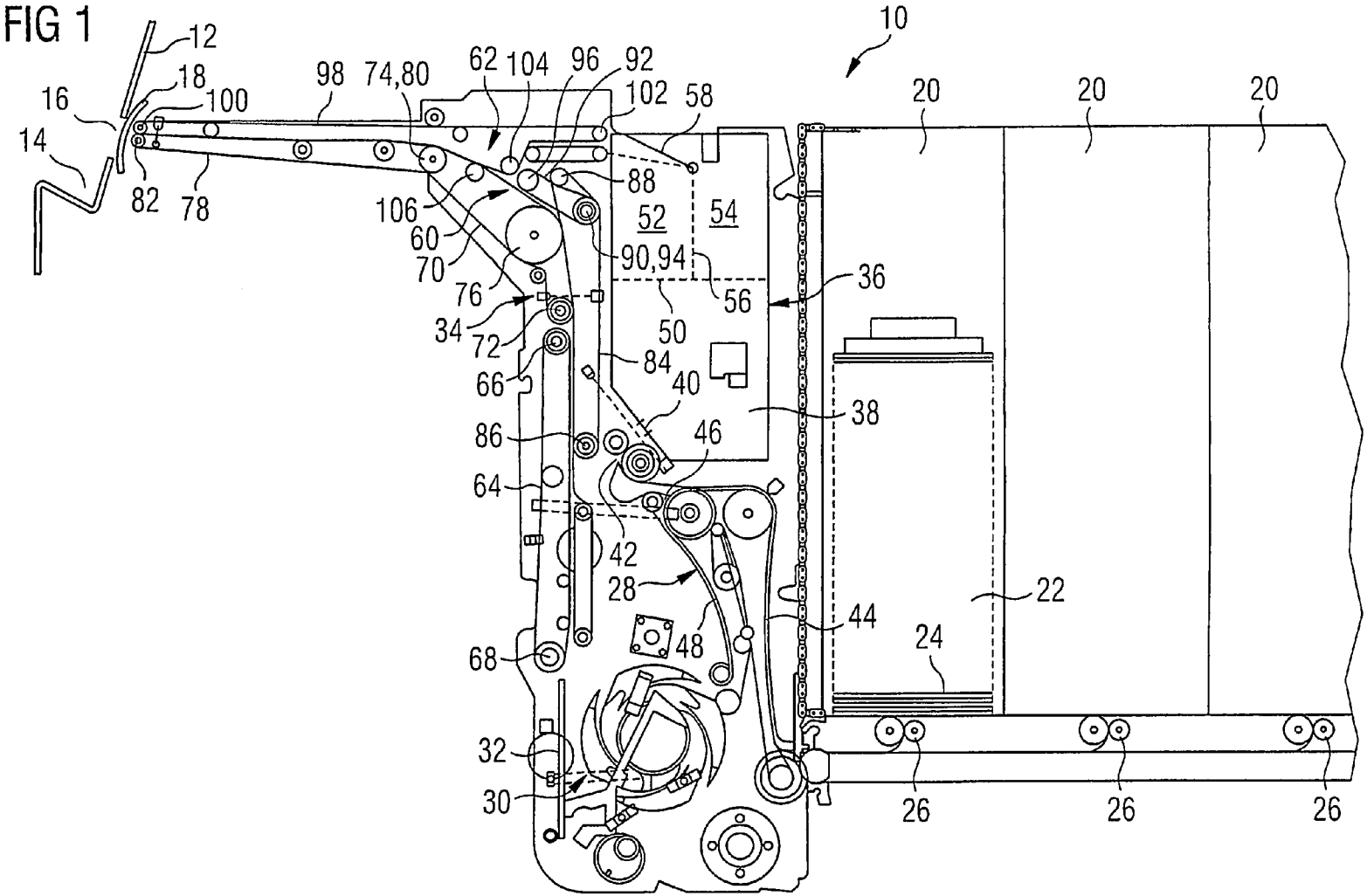
FIG. 1 is a schematic side view of a banknote cassette module with stacking and transport devices.

FIG. 1 shows schematically a cassette module, indicating generally at 10, which in its entirety is insertable into a non-illustrated drawer, by means of which it is slidable into, and again withdrawable, from the safe of a cash dispenser. Of the cash dispenser only a portion 12 of the housing with an optional output compartment 14 is indicated. A dispensing slot 16 in the housing 12 can be closed by a flap 18.

The banknote cassette module 10 includes a number of banknote cassettes 20, each which is oriented in vertical position or installation, and which cassettes are arranged behind one another in horizontal direction. Each banknote cassette 20 therefore contains a vertical banknote stack 22 from which the lower most banknote 24 can be withdrawn downwardly with the help of a schematically indicated individualizing device 26. The separated banknotes are then transported by a single sheet transport device, indicated in general at 28, to a stacking device 30 in which the individual banknotes are assembled into a banknote bundle or wad at a support surface 32. This wad is then transported by a wad and dispensing transport, indicated generally at 32, to the dispensing slot 16 and offered to the customer for removal.

Above the single sheet transport 28 is a return cassette 36, which customarily is also sometimes referred to as a reject/retract cassette. It contains a first compartment or reject chamber 38 with an inlet opening 40 arranged in front of the transport rolls 42. Individual banknotes which are withdrawn by the separating devices 26 are transported by a first transport branch 44 of the individual sheet transport 28 to a deflector 46, from which the notes can be guided to a second branch 48 of the individual sheet transport 28 to the stacking device 30. By a switching of the deflector 46 the individual sheets can, however, also be guided to the transport rolls 42 and from these delivered into the reject compartment 38. The reject compartment 38 is intended for the reception of those individual banknotes, which because of pre-given reasons cannot be dispensed. In most case, this concerns multiple withdrawals, that is individual banknotes that cling to one another and which in their withdrawal cannot be cleanly separated from one another.

The arrangement as described to this point is known in itself and need not be described in more detail.

Inside of the return container 36 two wad receiving compartments 52 and 54 are provided which are located above the reject compartment 38 and are separated from it by a separating wall 50, and the compartments 52 and 54 are in turn separated from one another by an intermediate wall 56. Pivotally connected to the upper end of the intermediate wall 56 is a flap 58 which is movable between the position represented by the full line and the position represented by the broken line. The wad receiving compartments 52 and 54 serve to receive banknote wads which were offered to a customer at the dispensing slot 16 but were not removed from the slot. After a pre-given definite waiting time, such a banknote wad is drawn back into the dispenser. Since this wad has already been charged to the customer account, this money must be attended to separately from the individual banknotes in the reject compartment 38 so that it can be associated with and credited to the account of the customer. Since such a procedure is relatively rare, generally two such wad receiving compartments are sufficient to ensure that the operation of the cash dispenser does not have to be prematurely interrupted during the course of an operating interval, as would occur if a further withdrawal of a wad becomes necessary for which no more storage space is available. The construction of the wad transport which permits a withdrawal of an offered banknote wad and its then placement into one of the banknote receiving compartments 52, 54 will now by explained in more detail with the help with FIGS. 2 and 3.

The wad dispensing transport 34 is made of two belt stretches 60, 62 between which a banknote wad can be transported. The first belt stretch 60 includes a first endless belt 64 which is guided over two end rolls 66, 68 and diverse non-illustrated support rolls. Following it is a second endless belt 70 guided over end rolls 72 and 74 and over a supporting roll 76. A third endless belt 78 finally runs over an end roll 80, co-axial with the end roll 74, and an end roll 82 located near the dispensing slot 16 as well as over further non-illustrated supporting rolls.

The second belt stretch 62 includes an endless belt 84 guided over two end rolls 86 and 88 as well as over a supporting roll 90 so that it lies on the endless belt 64 and onto a portion of the endless belt 70 and together with these belts forms an advancement slot for a banknote wad.

Following the stretch formed by the endless belt 84 is a further endless belt 92 which passes over a roll 94, co-axial with the end roll 90, and over an end roll 96, and which over a short length cooperates with the endless belt 70 of the first belt stretch 60 to convey a banknote wad. Finally, the second belt stretch 62 includes a third endless belt 98 which, on one hand, is guided over an end roll 100 near the dispensing slot 16 and, on the other hand, over an end roll 102 near the return container 36, as well as over several supporting rolls non-indicated in more detail. The endless belt 98 cooperates with the endless belt 78 and the endless belt 70 to convey banknote wads.

The endless belts 98 and 70 are made so as to be somewhat elastic so that they can stretch to a certain extent and thereby can be deflected, each belt runs respectively over a switching roll 104 or 106. The switching roll 104 is rotatably supported on the arm of a two-armed lever 108, which lever in turn is pivotally supported for movement about an axis 110 fixed relative to the dispenser and at the end of its other arm carries a cam follower 112, which is guided on a cam path 114, for example under spring pressure. The switching roll 106, over which the endless belt 70 runs, is rotatably supported on an arm of a two-armed lever 116, which is pivotal about an axis 118 fixed relative to the device, and at the end of its other arm carries a cam follower 120, which likewise is guided on the cam path 114. The cam path 114 is formed on a switching cam 124 rotatable about an axis 122.

Figure 2:
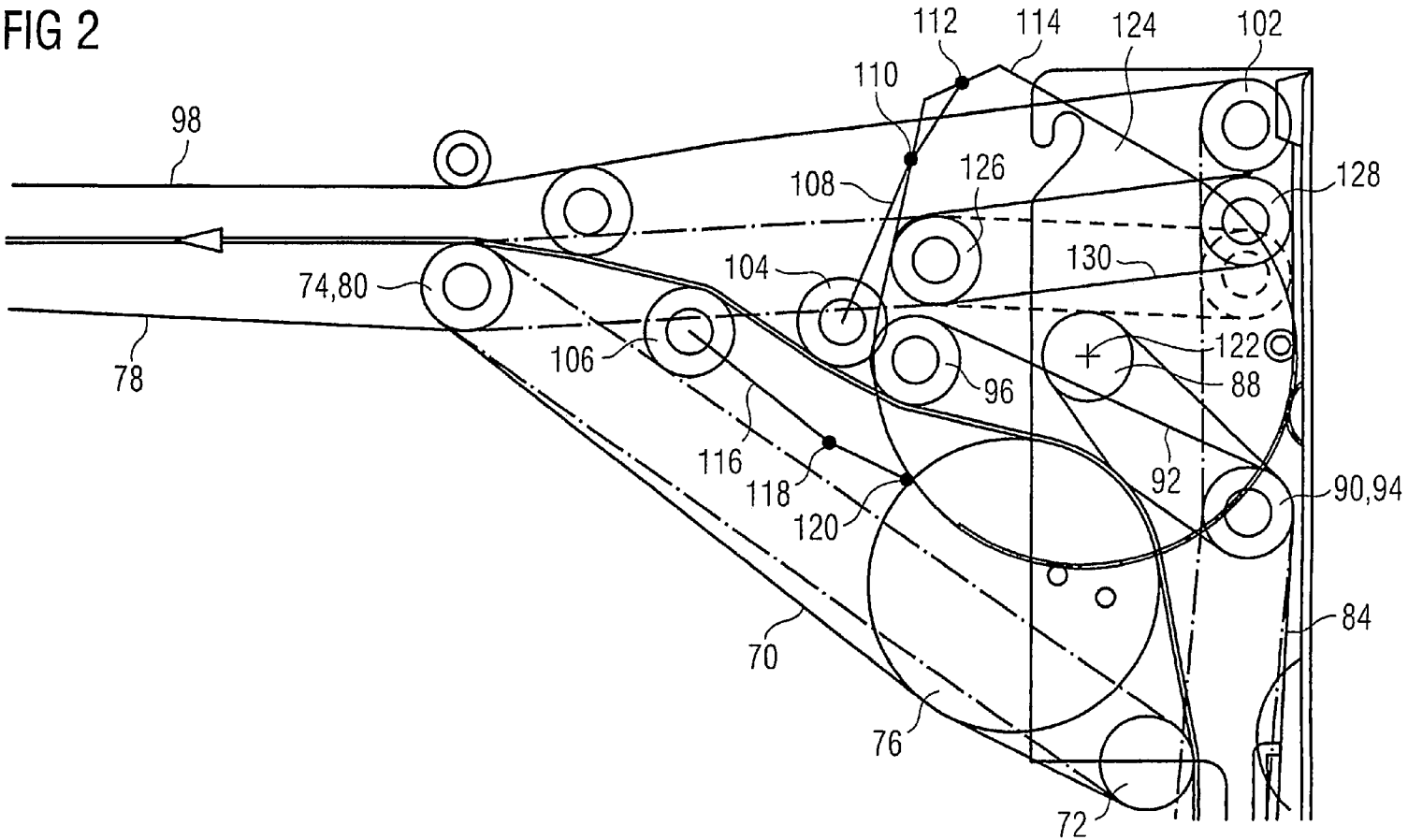
FIG. 2 is an enlarged detailed illustration of a branching location inside of the wad transport device in a first condition at which it connects the stacking device with the dispensing slot.

FIG. 2 shows one position of the switching cam 124 and of the switching rolls 104, 106 in which the endless belt 70 is only insignificantly deflected, and the switching roll 104 is so far deflected against the endless belt 98 that the switching roll 104 lies directly close to the end roll 96, over which the endless belt 92 is guided. Therefore one obtains a through-going transport stretch from the stacking device 30 to the dispensing slot 16.

Figure 3:
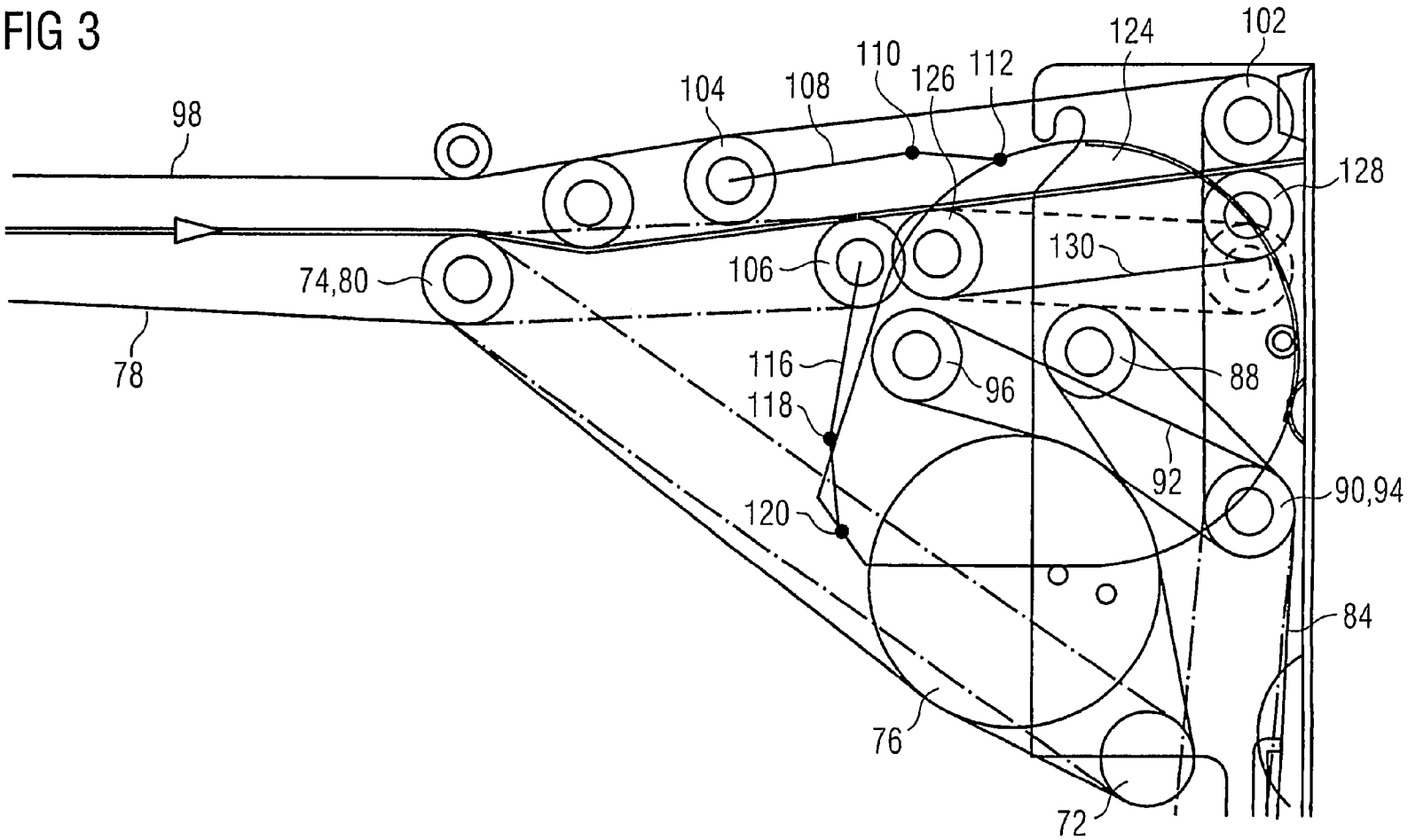
FIG. 3 is a view corresponding to FIG. 2 of the branching location of the wad transport device in a second condition at which it connects the dispensing slot with the wad receiving compartment of the return cassette.

In the position of the switching cam 124 and of the switching rolls 104 and 106 illustrated in FIG. 3, on the other hand, the switching roll 104 is so far pivoted that the endless belt 98 is practically not deflected so that it extends almost straightly from the end roll 80 of the endless belt 78 to the end roll 102. The switching roll 106 on the other hand, is pivoted into nearness to an end roll 126 which together with a second end roll 128 near the end roll 102 serves to guide another endless belt 130. This endless belt 130 together with the section of the endless belt 98 which overlies it forms a branch transport, which in the illustrated condition of FIG. 3 of the switching rolls 104 and 106 continues the transport path between the endless belt 98 on one hand and the belts 78 and 70 on the other hand in the direction toward return container 36. It is seen that the switching rolls 104 and 103 by the deflection of the endless belts 98 and 70 form a switch which, after the reversal of the running direction of the endless belts 70, 78, and 98, can switch the transport path leading from the stacking device 30 to the dispensing compartment 14 to a transport path leading from the dispensing compartment 14 to the return cassette 36.

For so long as the wad receiving compartments 52 and 54 are empty, the flap 58 remains in the position given by the full lines. In this position, the flap 58 conducts a banknote wad delivered by the branch transport into the first wad receiving compartment 52. After this, the flap 58 moves to the position represented by the broken line. Should a further banknote wad be taken back, it will slide over the flap 58 into the second wad receiving compartment 54.

What is claimed is:

1. A cash dispenser with a number of banknote cassettes (20) for the reception of banknotes to be dispensed, wherein the banknote cassettes (20) are oriented vertically and are arranged in a horizontal row behind one another, with withdrawal and separating devices (26) associated with the banknote cassettes (20), with a stacking device (30) for forming a bundle of withdrawn banknotes, with an individual sheet transport device (28) for transporting individual banknotes from the withdrawal and separating device (26) to the stacking device (30), with a wad transport device (34) for the transport of a banknote wad from the stacking device (30) to a dispensing slot (16) of the cash dispenser, and with a return cassette (36) with a reject compartment (38) for the reception of withdrawn banknotes not suitable for dispensing, wherein the individual sheet transport device (28) is selectably linkable with an input opening (40) of the return cassette (36) or with the stacking device (30), characterized in that the return cassette (36) is located above the stacking device (30), that the return cassette (36) has at least one wad receiving compartment (52, 54) for the reception of a banknote wad separate from the reject compartment (38), that the wad transport device (34) is switchable in respect to its transport direction and by way of a switchable branch can be made connectable with an input opening of the wad receiving compartment (52, 54), and that the wad receiving compartment (52, 54) is arranged with vertical installation of the receiving cassette (36) above the reject compartment (38) intended for the reception of individual banknotes.

2. A cash dispenser, according to claim 1, further characterized in that the wad transport device (34) is made as a belt transport with two belt stretches (60, 62), each of which is guided over drive and support rolls and which include endless belts (64, 70, 78; 84, 92, 98) for engagement with the opposite flat surfaces of a banknote wad, that one of the belt stretches (60, 62) at a branching location is divided into a discharge sided section and a stacker sided section (98; 92, 84), that the branching location is connected with the input opening of the wad receiving compartment (52, 54) by way of a branch transport device (98, 130), and that in the region of the branching location the endless belt (98, 70) of at least one of the belt stretches (62, 60) is at least somewhat elastic and is thereby deflectable, and that it selectably connects the discharge sided section of the unbroken belt stretch (62) with the branch transport device (98, 130) or with the stacker sided section of the unbroken belt stretch (62).

3. A cash dispenser, according to claim 2, further characterized in that the branch transport device (98, 130) is likewise formed as a belt transport.

4. A cash dispenser, according to claim 2, further characterized in that the deflection of the involved endless belt (98; 70) is accomplished by means of a movable supporting roll (104; 106).

5. A cash dispenser, according to claim 4, further characterized in that the supporting roll (104; 106) is supported on an arm of a pivotal lever (108; 116) supported for movement about a spatially fixed axis (110; 118), another arm of which lever is guided on a cam path (114) of a switching cam (124).

6. A cash dispenser, according to claim 5, further characterized in that the sections of the endless belts (98; 70) of the two belt stretches (60; 62) which cooperate with one another in the region of the branching location are deflectable and that the movable support rolls (104; 106) are movable in common by the same switching cam (124).

7. A cash dispenser, according to claim 1, further characterized that by means of a flap (58) the banknote wads are guided into the wad receiving compartment (54).

8. A cash dispenser, according to claim 3, further characterized in that the deflection of the involved endless belt (98; 70) is accomplished by means of a movable supporting roll (104; 106).

9. A cash dispenser, according to claim 2, further characterized that by means of a flap (58) the banknote wads are guided into the wad receiving compartment (54).

10. A cash dispenser, according to claim 3, further characterized that by means of a flap (58) the banknote wads are guided into the wad receiving compartment (54).

11. A cash dispenser, according to claim 4, further characterized that by means of a flap (58) the banknote wads are guided into the wad receiving compartment (54).

12. A cash dispenser, according to claim 5, further characterized that by means of a flap (58) the banknote wads are guided into the wad receiving compartment (54).

13. A cash dispenser, according to claim 6, further characterized that by means of a flap (58) the banknote wads are guided into the wad receiving compartment (54).

* * * * *